US006397608B1

(12) United States Patent
Sakuma et al.

(10) Patent No.: US 6,397,608 B1
(45) Date of Patent: Jun. 4, 2002

(54) REFRIGERATOR

(75) Inventors: Tsutomu Sakuma; Koji Kashima; Masato Tago; Takashi Doi; Akihiro Noguchi, all of Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/722,383

(22) Filed: Nov. 28, 2000

(30) Foreign Application Priority Data

Nov. 30, 1999 (JP) ..... 11-339823
Jul. 13, 2000 (JP) ..... 2000-212744

(51) Int. Cl.[7] ..... G05D 23/32; F25B 41/00
(52) U.S. Cl. ..... 62/158; 62/174
(58) Field of Search ..... 62/174, 158, 159, 62/200, 527

(56) References Cited

U.S. PATENT DOCUMENTS 5,077,982 A * 1/1992 Shaffer ..... 62/199
5,465,591 A * 11/1995 Cur et al. ..... 62/439
5,694,779 A * 12/1997 Matsushima et al. ..... 62/114
6,016,662 A * 1/2000 Tanaka et al. ..... 62/199
6,209,332 B1 * 4/2001 Strauss ..... 62/199

FOREIGN PATENT DOCUMENTS

EP 04043262 2/1992
EP 09300949 11/1997

* cited by examiner

*Primary Examiner*—William C. Doerrler
(74) *Attorney, Agent, or Firm*—Pillsbury Winthrop LLP

(57) ABSTRACT

A refrigerator having a refrigerator evaporator and a freezer evaporator, capable of controlling the refrigerant circulation correctly and reducing the delay in the refrigerant behaviors. When freezer mode is to be switched to refrigerator mode, at the end of the freezer mode, a refrigerant recovery run recovers the refrigerant from the freezer evaporator and feeds it to a condenser before the refrigerator mode by running a compressor while blocking the refrigerant to the freezer evaporator and by running a compressor fan.

7 Claims, 14 Drawing Sheets

REFRIGERATOR

TECHNICAL FIELD

The present invention relates to a refrigerator provided with an evaporator for a refrigerator compartment and an evaporator for a freezer compartment.

BACKGROUND ART

A refrigerator provided with a refrigerator compartment and a freezer compartment, each compartment is equipped with a dedicated evaporator in some refrigerators of recent years. These refrigerators have a freezing cycle, as shown in FIG. 13.

In the freezing cycle 100 of FIG. 13, a condenser 103 is connected to the downstream side of a compressor 102, which is divided at its downstream into two branches. To one branch, there are connected a refrigerator compartment change-over valve (as will be abbreviated into the "R-valve") 104, a refrigerator compartment capillary tube (as will be abbreviated into the "R-capi") 106 and a refrigerator compartment evaporator (as will be abbreviated into the "R-eva") 108. To the other branch, there are connected a freezer compartment change-over valve (as will be abbreviated into the "F-valve") 110, a freezer compartment capillary tube (as will be abbreviated into the "F-capi") 112, a freezer compartment evaporator (as will be abbreviated into the "F-eva") 114 and a check valve 116. Moreover, the conduits from the check-valve 116 and the R-eva 108 circulate through the compressor 102.

On the other hand, an R-fan 118 is provided for feeding the air cooled in the R-eva 108 to the refrigerator compartment, and the F-eva 114 is equipped with an F-fan 120.

In the aforementioned freezing cycle 100, the prior art control method will be described with reference to FIG. 14.

In this control method, a refrigerating run (as will be abbreviated into the "R-mode") for cooling the refrigerator compartment and a freezing run (as will be abbreviated into the "F-mode") for cooling the freezer compartment are alternately carried out. When the refrigerator compartment reaches a predetermined temperature, specifically, the R-valve 104 is opened, but the F-valve 110 is opened to feed the refrigerant to the F-eva 114 thereby to establish the F-mode. When the freezer compartment reaches a predetermined temperature in the F-mode, on the other hand, the F-valve 110 is closed, but the R-valve 104 is opened to feed the refrigerant to the R-eva 108 thereby to establish the R-mode.

SUMMARY OF THE INVENTION

Here, the R-eva 108 and the F-eva 114 are different in evaporation temperature and in the calorie of evaporation enthalpy. If both the R-eva 108 and the F-eva 114 have a necessary cooling calorie of 40 W, therefore, the refrigerant flow rate in the R-eva 108 is twice as high as that of the F-eva 114 because of the difference in the calorie of the evaporation enthalpy. In other words, when the evaporation temperature rises from a low level to a high level, the necessary refrigerant flow rate is raised by the difference in the specific suction capacity of the compressor 102.

This difference in the refrigerant circulation rate between the R-eva 108 and the F-eva 114 causes the delay in the refrigerant behaviors at the transition from the F-mode to the R-mode. For the first reason, the refrigerant flowing at rate of 1 in the F-mode has to flow at a rate of 2 when the mode is switched to the R-mode. For the second reason, the compression ratio of the compressor 102 is high in the F-mode but falls in the R-mode, so that the refrigerant is reluctant to flow into the R-eva 108 due to the difference in the compression ratio.

Moreover, the aforementioned delay in the refrigerant behaviors triggers to establish the state, in which anywhere but the entrance portion of the R-eva 108 is not cooled, as shown in FIG. 13. There arises a problem that the exit or its vicinity is not cooled to a necessary temperature so that the sufficient cooling capacity is not exhibited. This problem affects the cooling capacity adversely.

On the other hand, the refrigerant, as has been stagnant in the F-eva 114, cannot flow to the compressor 102 when in the R-mode at the high pressure. As a result, the refrigerant circulation is so lessened as cannot be adjusted. Therefore, the flow rate of the refrigerant circulation in the freezing cycle 100 changes for each run. Moreover, this change causes a more delay in the refrigerant behaviors.

From the problems thus far described, there arise problems that the refrigerant circulation cannot be correctly controlled, and that the cooling ability cannot be correctly controlled.

In view of the foregoing problems, therefore, the invention contemplates to provide a refrigerator which can control the refrigerant circulation correctly and can reduce the delay in the refrigerant behaviors.

DISCLOSURE OF THE INVENTION

According to the invention, there is provided a refrigerator comprising: a compressor and a condenser connected in the recited order; an evaporator for a refrigerator compartment and an evaporator for a freezer compartment both connected in parallel to the downstream side of the condenser, and switching unit interposed between the condenser and the two evaporators for switching the passage for a refrigerant from the condenser, between the refrigerator compartment evaporator and the freezer compartment evaporator; and a condenser fan for cooling the condenser, a cold air circulation fan for the refrigerator compartment for blowing the cold wind of the refrigerator compartment evaporator to the refrigerator compartment, and a cold wind circulation fan for a refrigerator compartment for blowing the cold air of the refrigerator compartment evaporator to the freezer compartment, whereby a refrigerating run for cooling the refrigerator compartment by feeding the refrigerant to the refrigerator compartment evaporator and a freezing run for cooling the freezer compartment by feeding the refrigerant to the freezer compartment evaporator can be individually executed by switching the passage of the refrigerant by the switching unit, wherein at the end of the freezing run, a refrigerant recovery run for recovering the refrigerant from the refrigerator compartment evaporator and feeding it to the condenser is performed by running the compressor while blocking the refrigerant to flow to the freezer compartment evaporator with the switching unit and by running the condenser fan; and after this refrigerant recovery run, the refrigerating run is performed by switching the switching unit to feed the refrigerant only to the refrigerator compartment evaporator.

In a refrigerator according to the invention, after a predetermined time from the start of the refrigerant recovery run, the refrigerating run is performed by switching the switching unit to feed the refrigerant only to the refrigerator compartment evaporator.

In a refrigerator according to the invention, after the temperature of the freezer compartment evaporator reaches a predetermined level after the start of the refrigerant recovery run, the refrigerating run is performed by switching the switching unit to feed the refrigerant only to the refrigerator compartment evaporator.

In a refrigerator according to the invention, after the refrigerating run was performed by switching the switching unit to feed the refrigerant only to the refrigerator compartment evaporator, the cold air circulation fan for the refrigerator compartment is run when the temperature of the refrigerator compartment evaporator falls to a set level.

In a refrigerator according to the invention, when the compressor is to be stopped from the freezing run or the refrigerating run, a stop preparatory run for recovering the refrigerant from the freezer compartment evaporator or the refrigerator compartment evaporator to feed the refrigerant to the condenser is performed by running the compressor while switching the switching unit to block the refrigerant to be fed to the freezer compartment evaporator or the refrigerator compartment evaporator, and by running the condenser fan at a low speed, and after the stop preparatory run, the compressor and the condenser fan are stopped while the refrigerant to be fed to the freezer compartment evaporator or the refrigerator compartment evaporator being blocked by the switching means.

In a refrigerator according to the invention, after a set time from the start of the stop preparatory run, the compressor and the condenser fan are stopped while the refrigerant to be fed to the freezer compartment evaporator or the refrigerator compartment evaporator being blocked by the switching means.

In a refrigerator according to the invention, after the drive current value of the compressor became lower than a set level from the start of the stop preparatory run, the compressor and the condenser fan are stopped while the refrigerant to be fed to the freezer compartment evaporator or the refrigerator compartment evaporator being blocked by the switching means.

In a refrigerator according to the invention, the switching unit includes two two-way valves.

In a refrigerator according to the invention, the switching unit includes a three-way valve.

According to the invention a refrigerator includes a compressor and a condenser connected in the recited order; an evaporator for a refrigerator compartment and an evaporator for a freezer compartment both connected in parallel to the downstream side of the condenser, and switching unit interposed between the condenser and the two evaporators for switching the passage for a refrigerant from the condenser, between the refrigerator compartment evaporator and the freezer compartment evaporator; and a condenser fan for cooling the condenser, a cold air circulation fan for the refrigerator compartment for blowing the cold wind of the refrigerator compartment evaporator to the refrigerator compartment, and a cold wind circulation fan for a refrigerator compartment for blowing the cold air of the refrigerator compartment evaporator to the freezer compartment. Whereby a refrigerating run for cooling the refrigerator compartment by feeding the refrigerant to the refrigerator compartment evaporator and a freezing run for cooling the freezer compartment by feeding the refrigerant to the freezer compartment evaporator can be individually executed by switching the passage of the refrigerant by the switching unit. The refrigerator also including a block unit for blocking the refrigerant to flow to the refrigerator compartment evaporator and the freezer compartment evaporator; and a refrigerant recovery run for recovering the refrigerant to feed it to the condenser is performed by running the compressor while the refrigerant to flow to the refrigerator compartment evaporator and the freezer compartment evaporator being blocked by the block unit, and by running the condenser fan.

In a refrigerator according to the invention, the refrigerant recovery run is performed either when it is determined that the refrigerant is short in the refrigerator compartment evaporator or the freezer compartment evaporator or at the switching time when the refrigerating run and the freezing run are alternately performed.

In a refrigerator according to the invention, the speed of the compressor at the refrigerant recovery run is, continued from that of the compressor, which was set at the refrigerating run or at the freezing run before the transition to the refrigerant recovery run.

In a refrigerator according to the invention, the running time of the refrigerant recovery run is set the longer for the lower speed of the compressor.

In a refrigerator according to the invention, the running time of the refrigerant recovery run is set the longer for the lower ambient temperature.

In a refrigerator according to the invention, the refrigerant recovery run is stopped when the temperature of the refrigerator compartment evaporator or the temperature of the freezer compartment evaporator is lower than a set level.

In a refrigerator according to the invention, an accumulator is provided on the downstream side of the refrigerant of the refrigerator compartment evaporator, and the refrigerant recovery run is stopped when the temperature of the accumulator becomes lower than a set level.

In a refrigerator according to the invention, either the cold air circulation fan for the refrigerator compartment at the refrigerating run before the transition to the refrigerant recovery run or the cold air circulation fan for the freezer compartment at the freezing run is continuously rotated.

In a refrigerator according to the invention, the cold air circulation fan for the refrigerator compartment or the cold air circulation fan for the freezer compartment is stopped when the temperature of the refrigerator compartment evaporator and the temperature of the freezer compartment evaporator exceeds a set level.

The operations of the refrigerator of the present invention are described as follows.

When the freezing run is to be switched to the refrigerating run, at the end of the freezing run, the compressor is run while blocking the refrigerant to flow to the refrigerator compartment evaporator, and the condenser fan is also run.

As a result, the refrigerant from the freezer compartment evaporator is recovered and fed to the condenser, and this refrigerant is also liquefied by running the condenser fan, thus ending the refrigerant recovery run.

After this refrigerant recovery run, the switching unit is switched to feed the refrigerant only to the refrigerator compartment evaporator thereby to perform the refrigerating run. Thus, it is possible to prevent the delay in the refrigerant behaviors.

As the refrigerant recovery run, the control is made on the basis of the set time, or the refrigerating ran is started when the temperature of the freezer compartment evaporator reaches the set level.

The operations of the refrigerator of the present invention are described as follows.

After the refrigerating run was performed by switching the switching unit to feed the refrigerant only to the refrigerator compartment evaporator, the cold air circulation fan for the refrigerator compartment is run when the temperature of the refrigerator compartment evaporator falls to a set level. In other words, the cold air circulation fan is stopped at the time of starting the refrigerating run. Then, the liquid refrigerating run, as has been stagnant in the condenser, easily flows to the R-eva.

The operations of the refrigerator of the present invention are described as follows.

When the compressor is to be stopped from the freezing run or the refrigerating run, the stop preparatory run is performed, and the compressor and the condenser fan are then stopped while the refrigerant passages to the individual evaporators being blocked by the switching unit.

As a result, the liquefaction of the refrigerant can be promoted by recovering the refrigerant from the freezer compartment evaporator or the refrigerator compartment evaporator to feed it to the condenser and by running the condenser fan at a low speed.

Thus, the refrigerant easily flows to the evaporator at the next return of the compressor, so that the refrigerant delay can be eliminated.

On the other hand, the time for the stop preparatory run is controlled with the set time or ended when the current value for driving the compressor becomes lower than a set level.

Moreover, the switching unit can be exemplified by two two-way one or one three-way valve.

According to the invention, it is possible to adjust the balance between the refrigerants stagnant in the refrigerator compartment evaporator and the freezer compartment evaporator thereby to feed the refrigerants in proper amounts to the refrigerator compartment evaporator and the freezer compartment evaporator, thereby to suppress a useless increase in the input.

According to the invention, it is possible to eliminate the refrigerant delay, as might otherwise be caused when it is determined that the refrigerant in the freezer compartment or the refrigerator compartment is short or after the run was switched. Thus, the cooling can be performed efficiently while exploiting the performance of each evaporator sufficiently, to shorten the time period before the steady state is reached.

According to the invention, the control is facilitated, and the complicated fluctuation in the compressor speed is suppressed to reduce the noises.

According to the invention, the refrigerant can be recovered in a substantially proper amount by the simple control.

According to the invention, the proper amount of refrigerant can be recovered by the simple control even when the ambient temperature changes.

According to the invention, the excessive refrigerant recovery can be prevented to suppress the deterioration in the reliability of the compressor.

According to the invention, the cold heat in the evaporator, as might otherwise be cooled in an endothermic manner at the refrigerant recovery, can be circulated in the compartment so that the cooling effect of the circulation fan can be made effective to make a contribution to a constant temperature.

According to the invention, the input increase, as might otherwise be caused by excessively driving the circulation fan, can be suppressed to effect a more efficient cooling.

BRIEF DESCRIPTION THE DRAWINGS

BEST MODE FOR CARRYING OUT THE INVENTION

An embodiment of the invention will be described with reference to FIGS. 1 to 3.

Figure 1:
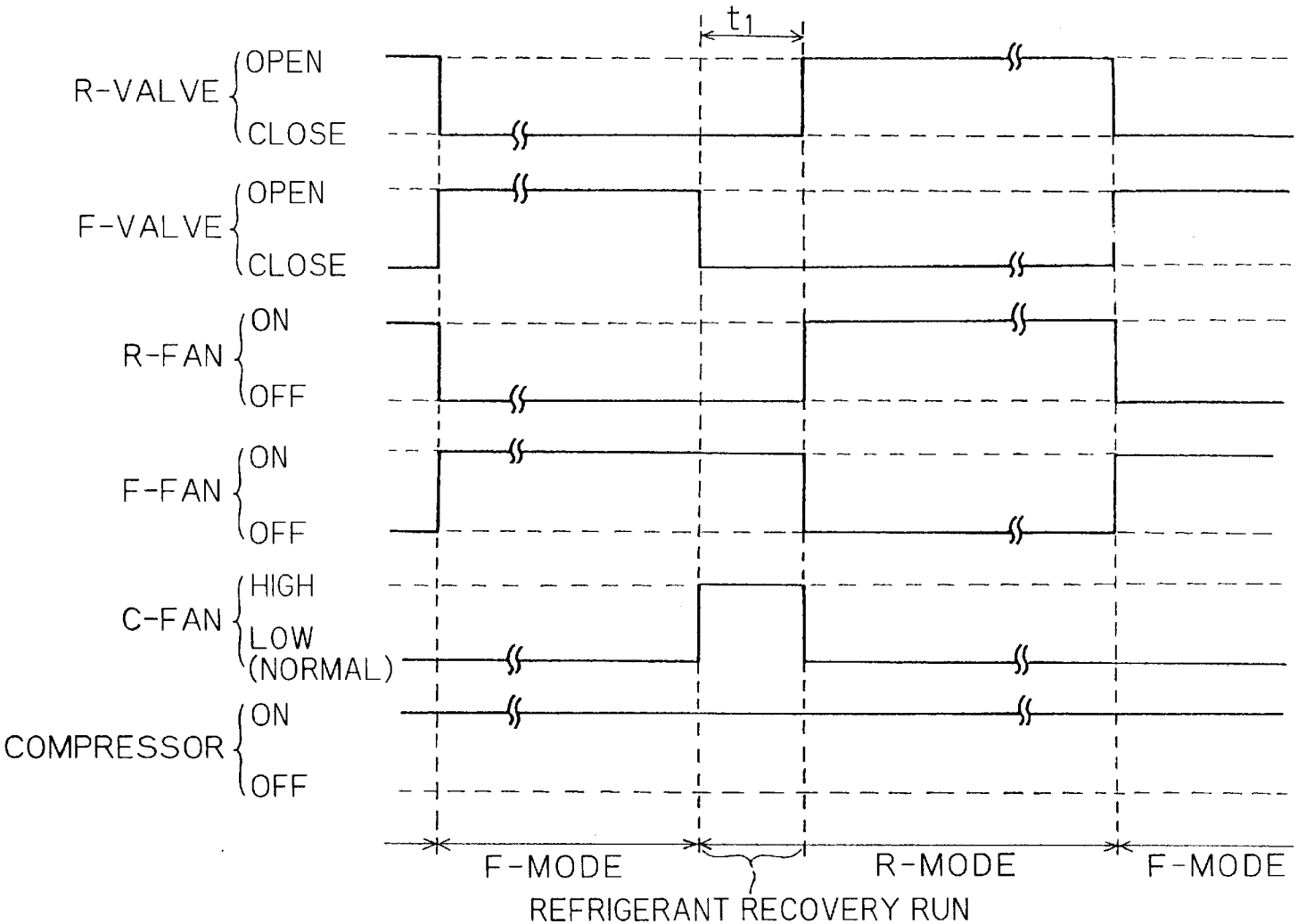
FIG. 1 is a timing chart illustrating the control state of a refrigerator according to an embodiment of the invention.

FIG. 1 is a timing chart illustrating the control state of a refrigerator 1 according to this embodiment; FIG. 2 is a vertical section of the refrigerator 1; and FIG. 3 is a diagram of a freezing cycle 10 of the refrigerator 1.

First of all, the structure of the refrigerator 1 will be described with reference to FIG. 2.

The refrigerator 1 is provided, in the recited downward order, with a refrigerator compartment 2, a crisper 3, an ice compartment 4 and a freezer compartment 5.

In a machine compartment 6 on the back of the freezer compartment 5, there is disposed a compressor 12. On the back of the ice compartment 4, on the other hand, there mounted an F-eva 24 and an F-fan 30. On the back of the crisper 3, there are mounted an R-eva 18 and an R-fan 28. In the vicinity of the compressor 6, there is disposed a condenser fan (as will be abbreviated as "C-fan") 32 for cooling the compressor 12 and a condenser 13.

Here, the F-eva 24 cools the ice compartment 4 and the freezer compartment 5, and the R-eva 18 cools the refrigerator compartment 2 and the crisper 3.

Here will be described the structure of the freezing cycle 10 of the embodiment with reference to FIG. 3.

To the downstream side of the compressor 12, there is connected the condenser 13, the downstream side of which is branched into two conduits. To one conduit, there are connected an R-valve 14 of a two-way valve, an R-capi 16 and the R-eva 18. To the other conduit, on the other hand, there are connected an F-valve 20 of a two-way valve, an F-capi 22 and the F-eva 24, to the downstream side of which there is connected a check valve 26. Moreover, the conduit from the check valve 26 and the conduit from the R-eva 18 merge into one to circulate through the compressor 12.

The operating stales of the refrigerator 1 will be explained with reference to the time chart of FIG. 1.

(1) F-mode

In the F-mode for cooling the ice compartment 4 and the freezer compartment 5, the R-valve 14 is closed, but the F-valve 20 is opened. On the other hand, the R-fan 28 is turned OFF, but the F-fan 30 is turned ON. Moreover, the C-fan 32 is rotated at a normal speed.

Then, the refrigerant flows not into the R-eva 18 but into the F-eva 24 to cool this F-eva 24, and this cooled air is blown to the ice compartment 4 and the freezer compartment 5 by the F-fan 30. The evaporation temperature of the F-eva 24 of this case is about at −25° C.

(2) Transition from F-mode to R-mode

When the compartment temperature of the ice compartment 4 or the freezer compartment 5 falls to a predetermined level whereas the compartment temperature of the refrigerator compartment 2 or the crisper 3 rises to a predetermined level, it is necessary to switch the mode from the F-mode to the R-mode. In this case, the transition is made at the next stage.

At the first stage, not only the R-valve 14 but also the F-valve 20 is closed. On the other hand, the C-fan 32 runs at a high speed. In this state, the compressor 12 is continuously run to draw and recover the refrigerant stagnant in the F-eva 24, and this recovered refrigerant is fed to the condenser 13. In this condenser 13, the C-fan 32 is run at the high speed to promote the condensation and the liquidation of the refrigerant so that this liquefied refrigerant is reserved in the condenser 13.

The run at this first stage will be called the "refrigerant recovery run". Moreover, this refrigerant recovery run is performed for a set time t1 (e.g., 2 mins.) after the end of the F-mode.

At a second stage, when the refrigerant recovery run ends, the R-valve 14 is opened while the F-valve 20 being closed, to feed the liquid refrigerant of the condenser 13 to the R-eva 18.

Thus, the liquid refrigerant, as stagnant in the condenser 13, easily flows into the R-eva 18 so that the entrance and exit temperatures of the R-eva 18 can be substantially equalized to eliminate the refrigerant delay.

Figure 4:
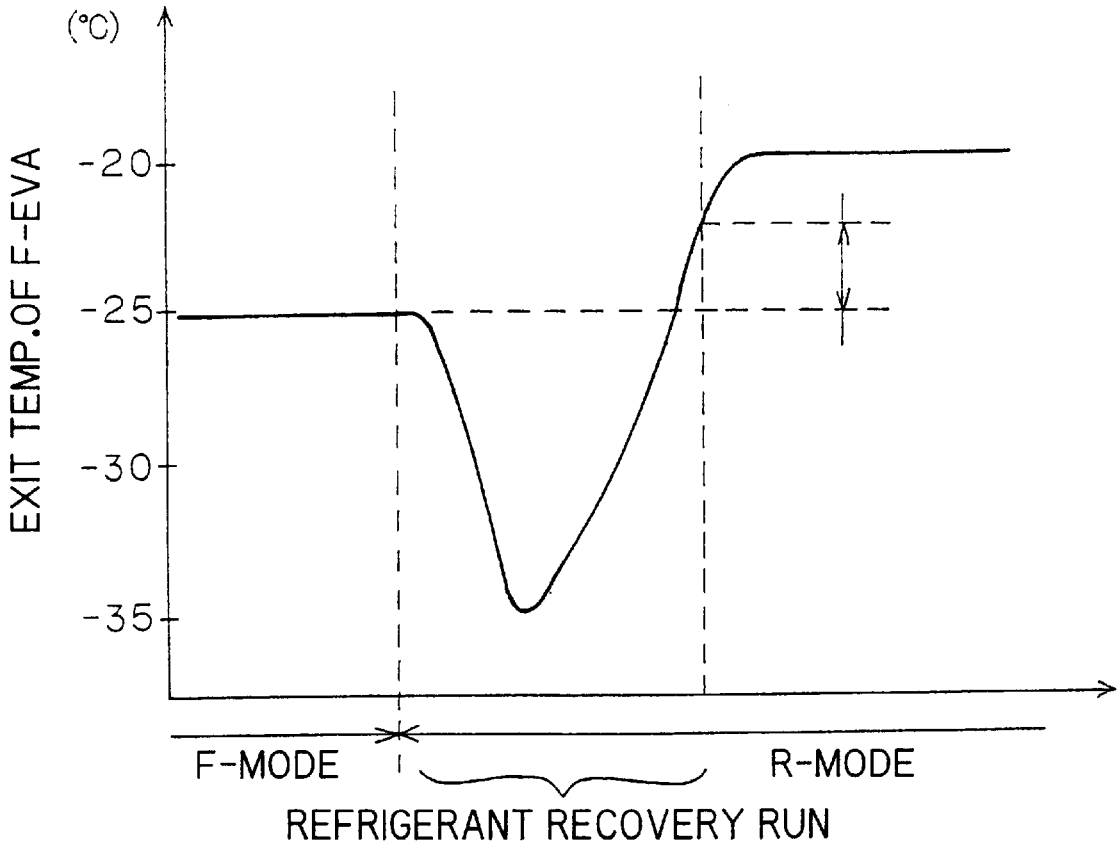
FIG. 4 is a graph illustrating the exit temperature of an F-Eva and the running state of another embodiment.

Another embodiment will be described with reference to FIG. 4.

The difference of this embodiment from the previous embodiment resides in that the ending timing of the refrigerant recovery run from the F-mode to the R-mode is determined in terms of the exit temperature of the F-eva 24.

This F-eva 24 is run at about −25° C. in the F-mode. At the transition from the F-mode to the R-mode, the C-fan 32 is run at the high speed while the F-valve 20 being closed but the F-fan 30 being run, as described in connection with the first embodiment.

Then, the refrigerant, as stagnant in the F-eva 24, evaporates with the compartment temperature. On the other hand, the inside of the F-eva 24 is evacuated by the compressor 12. As a result, the temperature of the F-eva 24 gradually falls, as illustrated in FIG. 4.

When the refrigerant is exhausted, however, no medium is left to be heat-exchanged, so that the compartment temperature begins again to rise. When the rising exit temperature of the F-eva 24 grows higher by 2 or 3° C. than a predetermined level (e.g., −25° C.), the end of the refrigerant recovery run is operable to open the R-valve 14.

Thus, it is possible to judge the ending timing of the refrigerant recovery run reliably.

Figure 5:
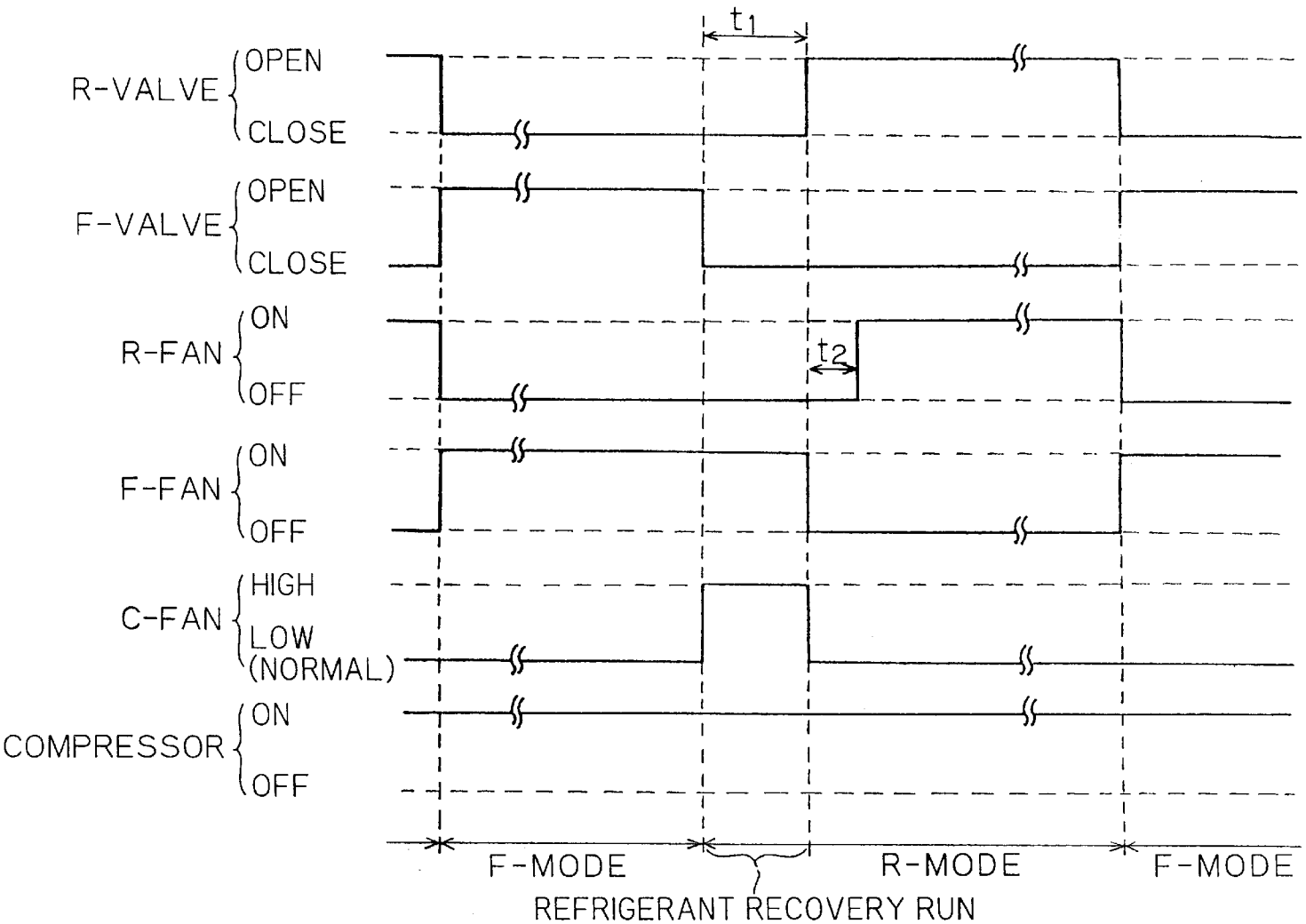
FIG. 5 is a timing chart illustrating the control state of yet another embodiment.

Another embodiment will be described with reference to FIG. 5.

The difference of this embodiment from the former embodiment of the previous embodiments resides in the following. At the end of the refrigerant recovery run, the mode is switched to the R-mode. In this case, the R-fan 28 is not instantly rotated but is left irrotational at the beginning.

After the switching from the refrigerant recovery run to the R-mode, more specifically, the R-fan 28 is stopped at first. Moreover, this stopped state of the R-fan 28 is continued till the exit temperature of the R-eva 18 becomes low. Here, the R-fan 28 may be stopped only for a set time t2.

The reason for this run will be described in the following. When the refrigerator compartment 2 and the crisper 3 rise in temperature in the F mode, the refrigerant flows in this state.

If the R-fan 28 is rotated, the liquid refrigerant is promptly evaporated and gasified in the R-eva 18. As a result, the pressure in the piping of the R-eva 18 rises, and the gas has a high pressure loss thereby to cause a phenomenon that the refrigerant becomes stagnant. Therefore, the cooling capacity has to be recovered as soon as possible by feeding the refrigerant to the exit of the R-eva 18 to suppress that gasification thereby to lower the temperature of the R-eva 18 homogeneously.

Figure 6:
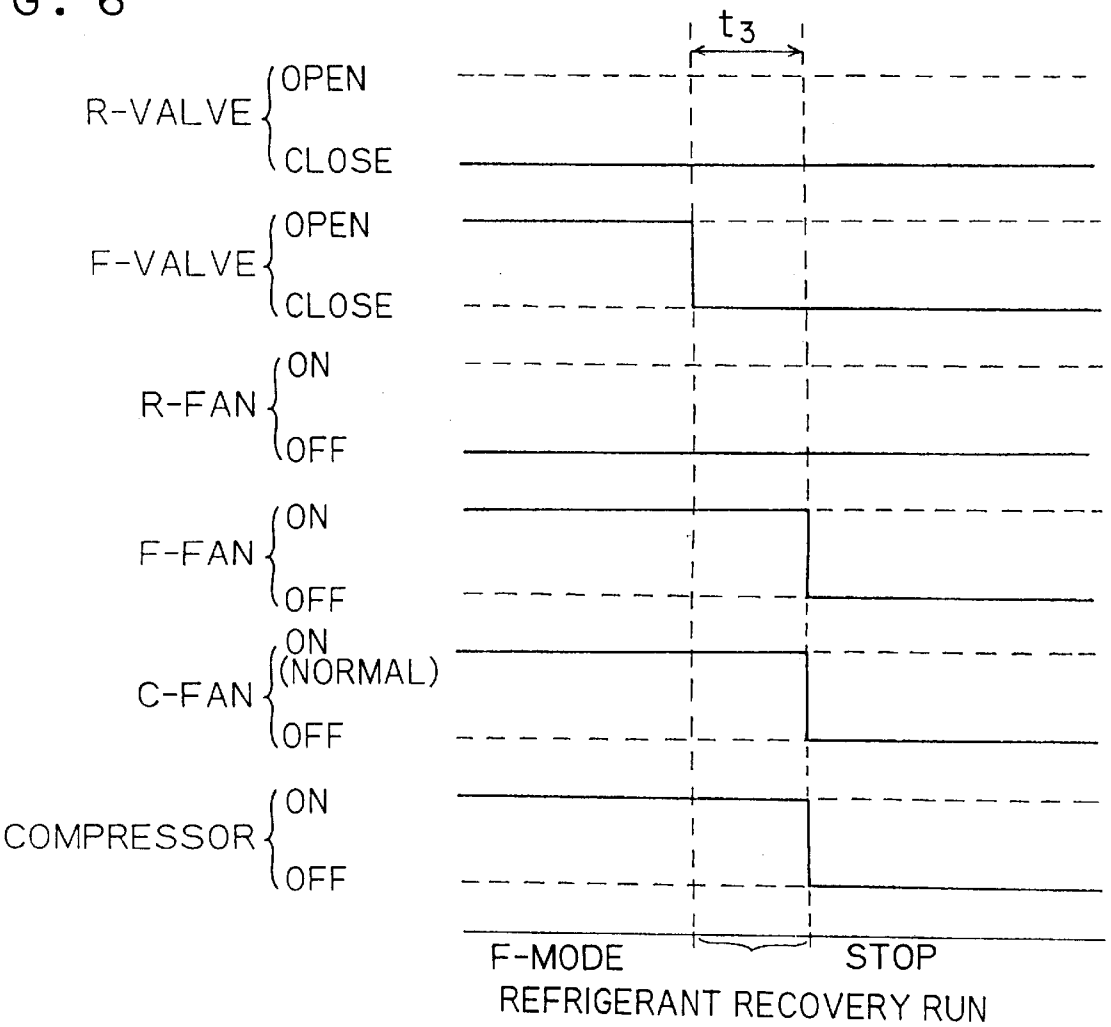
FIG. 6 is a timing chart illustrating the control state of yet another embodiment.

Another embodiment will be described with reference to FIG. 6.

Unlike the previous embodiments, this embodiment establishes the control state of the case the compressor 12 is stopped from the F-mode. Here, the structures of the refrigerator 1 and the freezing cycle 10 are similar to those of the embodiment of FIGS. 1–3.

When the F-mode ends, not only the R-valve 14 but also the F-valve 20 is closed. Moreover, the R-fan 28 remains in the OFF state, and the F-fan 30 remains in the ON state. On the other hand, the C-fan 32 is also rotated at the normal speed. In this state, the compressor 12 is running, and the liquid refrigerant, as stagnant in the F-eva 24, is drawn and recovered so that it is fed to the condenser 13. The refrigerant thus discharged to the condenser 13 is condensed and liquefied because the C-fan 32 is rotating, so that it is reserved in the liquid state in the condenser 13. This running state will be called the "stop preparatory run".

The compressor 12 is stopped after this stop preparatory run is performed for a set time t3 from the end of the F-mode.

By this stop preparatory run, the refrigerant is liable to flow to the evaporator when the next run of the compressor 12 is restored, so that the refrigerant delay can be eliminated. By blocking the condenser 13, the R-eva 18 and the F-eva 24 with the F-valve 20 and the R-valve 14 during the stop of the compressor 12, on the other hand, the hot gas in the condenser 13 does not flow into the two evaporators so that the evaporator temperature does not rise. In short, the compartment temperature of the refrigerator 1 does not rise so that the restoration is accelerated.

Here in this embodiment, this stop preparatory run is performed at the end of the F-mode but can also be performed in the R-mode.

Figure 7:
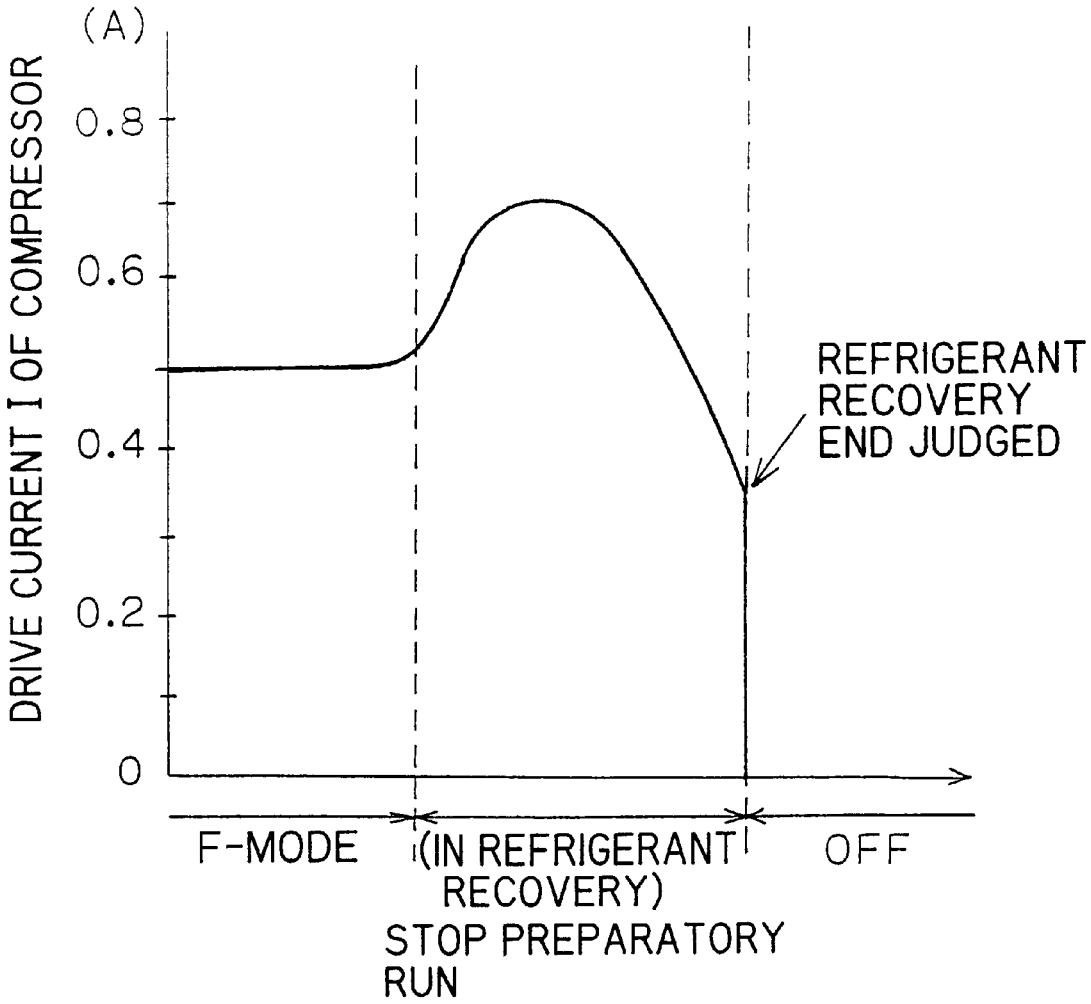
FIG. 7 is a graph illustrating the drive current of a compressor and the running state of yet another embodiment.

Yet another embodiment will be described with reference to FIG. 7.

The difference of this embodiment from the previous embodiment resides in that the timing for ending the stop preparatory run is determined in terms of not the set time but the current for driving the compressor 12. In the F-mode, more specifically, the compressor 12 is run with a driving current I of about 0.5 A (or 50 W). In the stop preparatory run, however, the discharge pressure and the suction pressure are different to load the compressor 12 so that the input of the drive current I rises.

When the amount of the drawn refrigerant becomes smaller, however, the load on the compressor 12 is lessened to lower the input value of the drive current I. When it is determined by detecting the lowered value that the refrigerant has been recovered, the compressor 12 is stopped.

As a result, the stop preparatory run can be ended at the instant when the refrigerant is reliably recovered.

In the previous embodiments, the R-valve 14 and the F-valve 20 are made of the different two-way valves but may be replaced by a three-way valve integrating those two valves.

This three-way valve has one entrance and two exits so that it can realize the following three states.

In the first state, the first exit (i.e., the exit to the R-eva 18) is opened, but the second exit (i.e., the exit to the F-eva 24) is closed.

In the second state, the first exit (i.e., the exit to the R-eva 18) is closed, but the second exit (i.e., the exit to the F-eva 24) is opened.

In the third state, the first exit (i.e., the exit to the R-eva 18) is closed, and the second exit (i.e., the exit to the F-eva 24) is closed.

Another embodiment will be described with reference to FIGS. 8 to 11.

Figure 2:
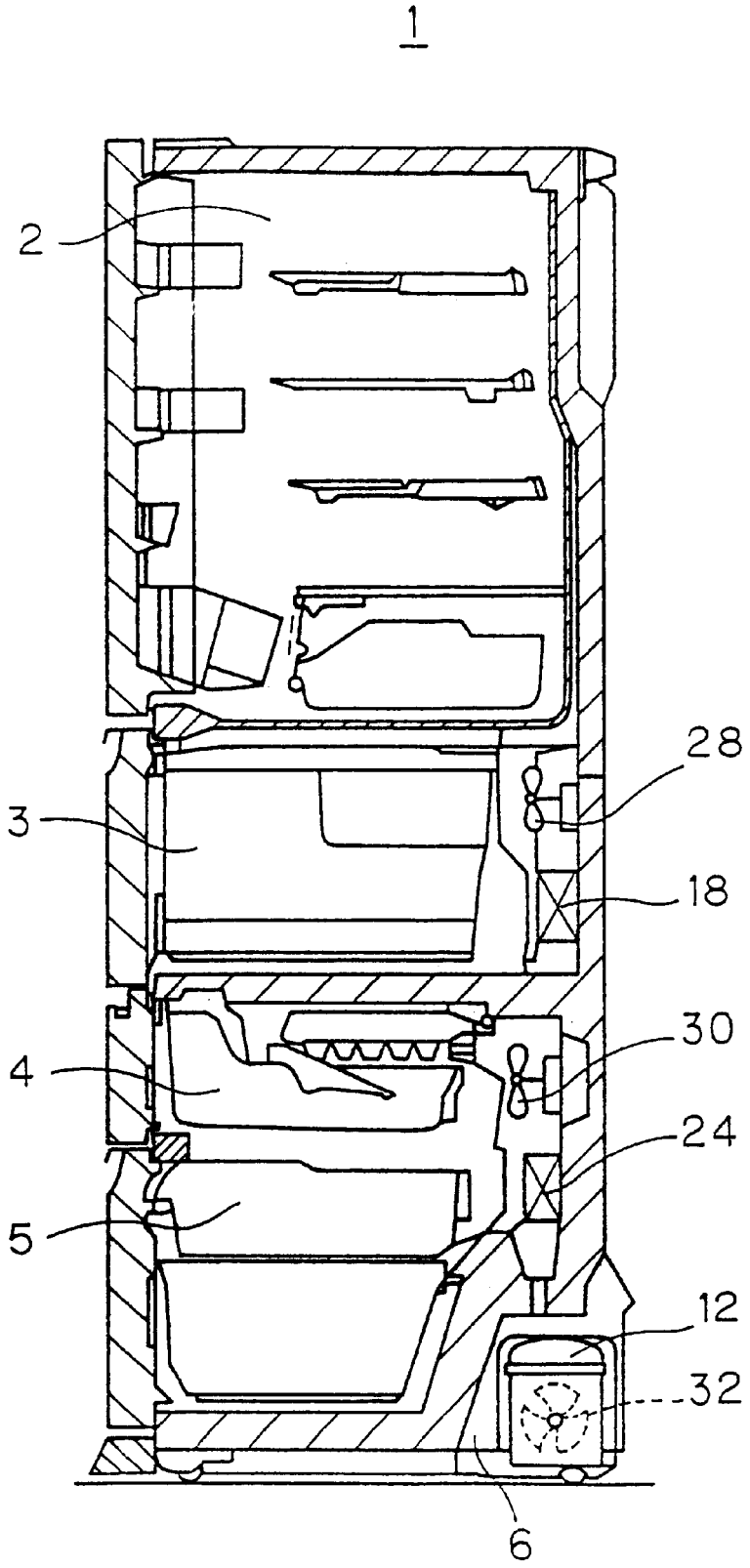
FIG. 2 is a vertical section of the refrigerator.
Figure 3:
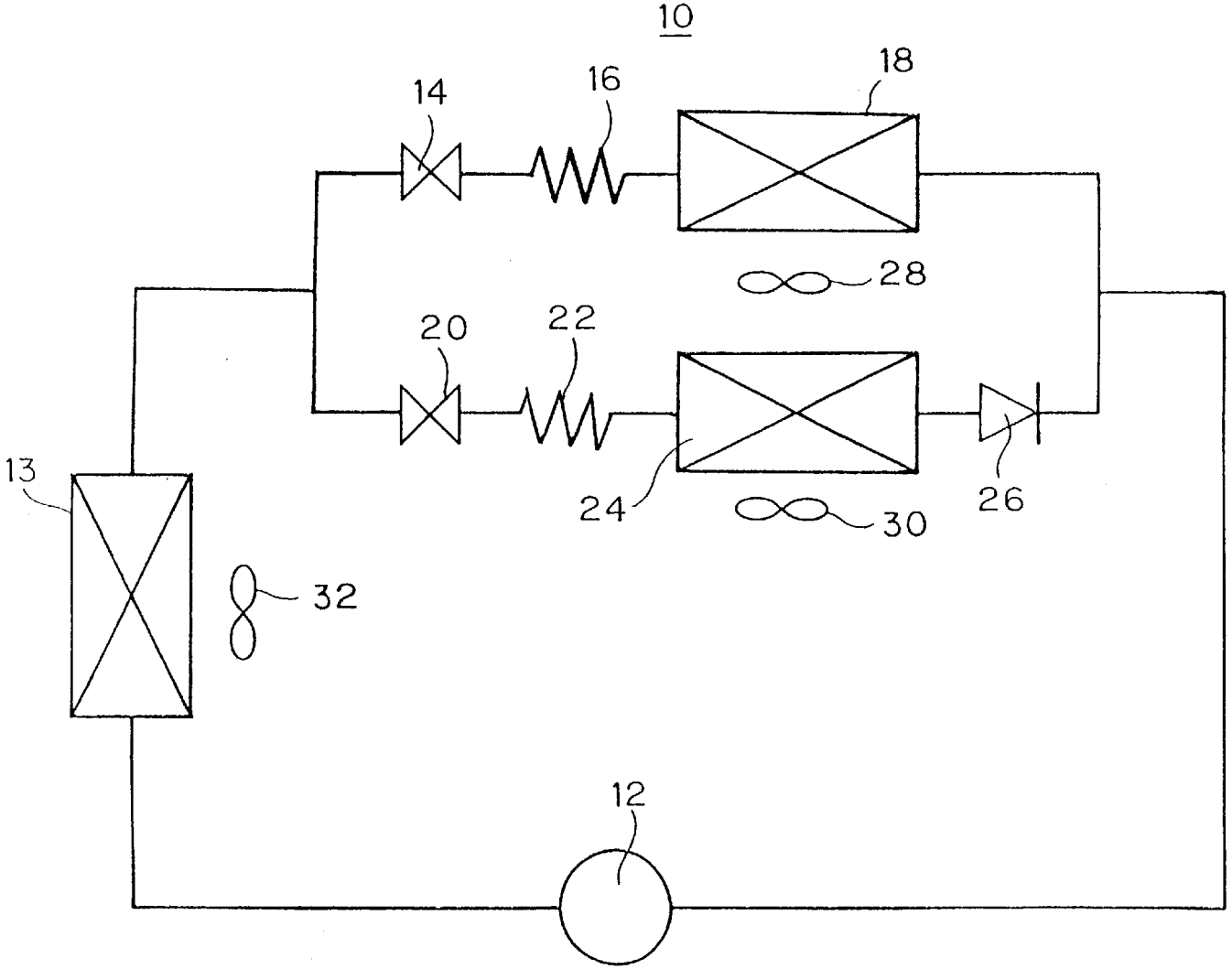
FIG. 3 is a diagram of a freezing cycle of the refrigerator.
Figure 8:
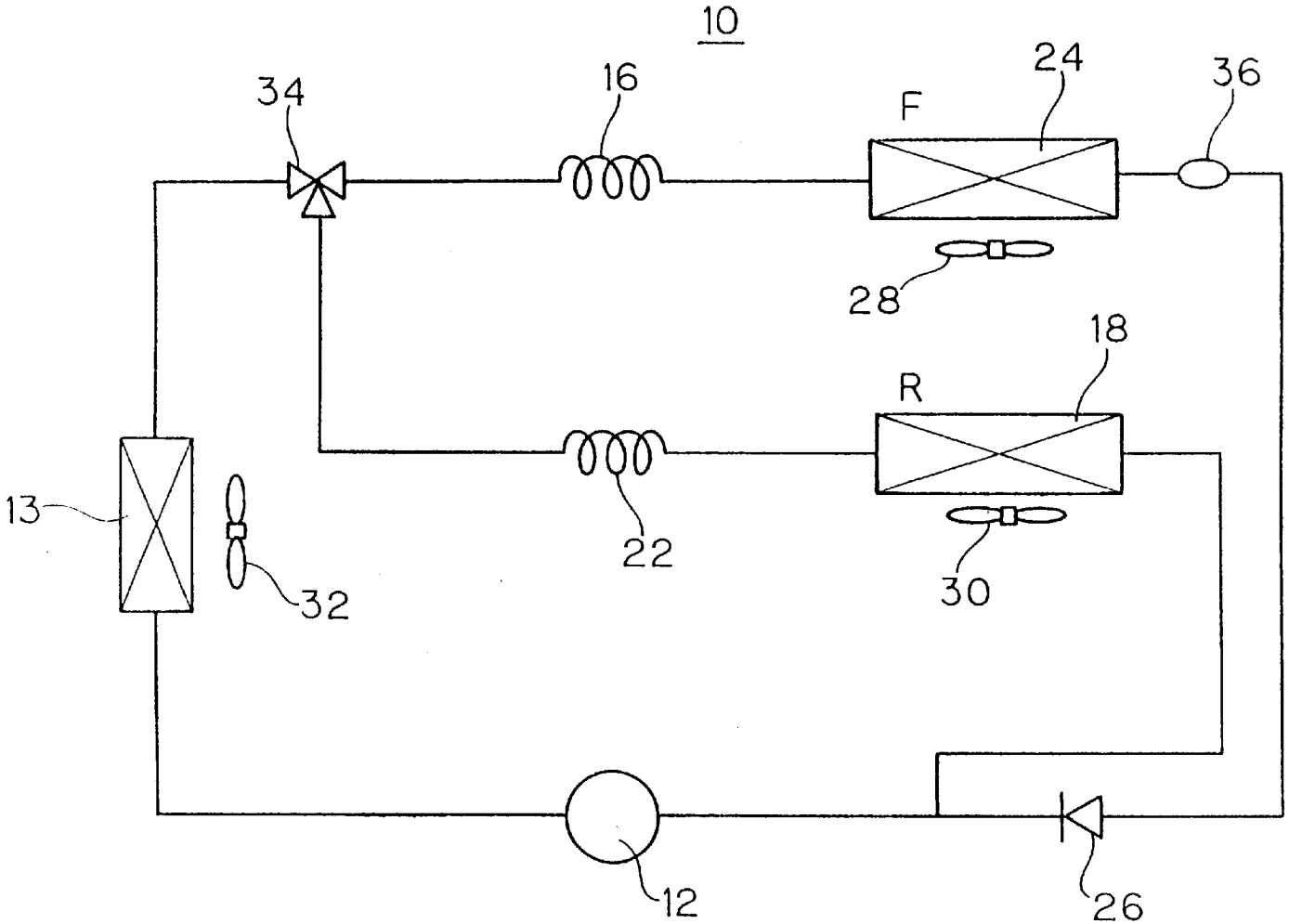
FIG. 8 is a diagram showing the freezing cycle of yet another embodiment.

FIG. 8 shows the structure of the freezing cycle 10 of this embodiment, which is different from the embodiment of FIGS. 1–3 in that a three-way valve 34 is provided in place of the R-valve 14 and the F-valve 20. On the other hand, an accumulator 36 is interposed between the F-eva 24 and the check valve 26. Here, the three-way valve 34 is of the fully closed type capable of establishing the three states, in which the refrigerant is fed to the R-eva 18, in which the refrigerant is fed to the F-eva 24, and in which the refrigerant is not fed to both the R-eva 18 and the F-eva 24.

(1) Control Method of the Prior Art

First of all, here will be described the control method of the prior art.

Figure 9:
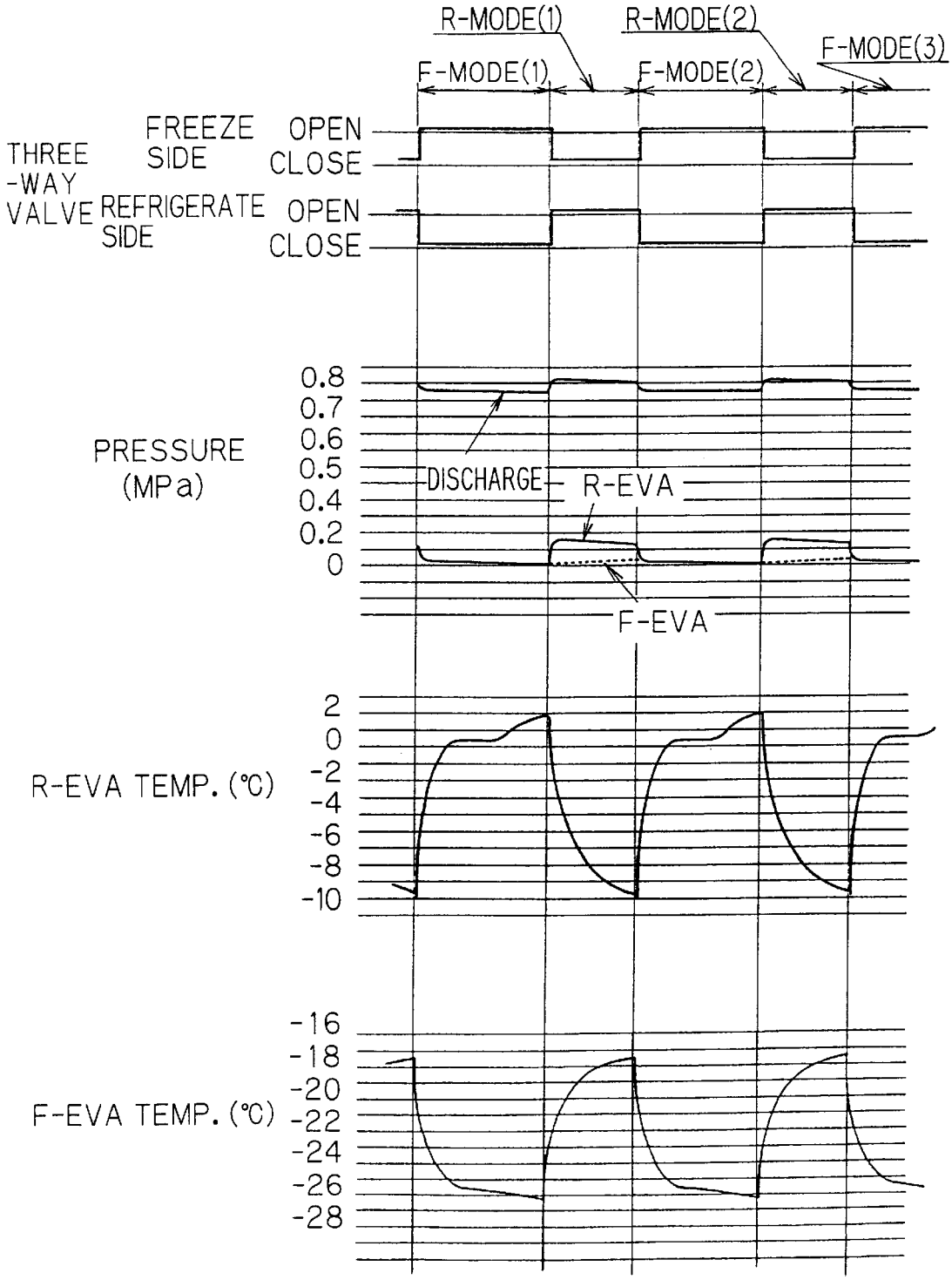
FIG. 9 is a timing chart illustrating the ideal states of the temperature of an R-Eva and the temperature of the F-Eva.

The behaviors of the pressure states of the R-eva 18 and the F-eva 24, as in the alternate cooling runs for the F-mode and the R-mode, and the ideal temperature changes of the individual evaporators are illustrated in FIG. 9.

Normally, in the R-mode, the R-eva 18 has a pressure of about 0.2 MPa and a temperature of about −10° C. On the other hand, the F-eva 24 has a pressure of about 0.1 Mpa and a temperature of about −26° C.

Specifically in the R-mode, as illustrated in FIG. 9, the pressures in the evaporators are higher in the R-eva 18 than in the F-eva 24, so that the check valve 26 is closed by the pressure difference to reserve the cold refrigerant in the F-eva 24. When the mode is switched from this state to the F-mode, moreover, the cold refrigerant can be used for the cooling operation so that the efficient cooling can be effected in the F-mode without the refrigerant delay.

Next, in the F-mode, the F-eva 24 has a pressure of about 0.1 MPa and a temperature of about −26° C., and the R-eva 18 has a temperature of 0 to 2° C. but a pressure of 0.1 MPa equal to that of the F-eva 24.

In the F-mode, therefore, the pressure of the R-eva 18 is lower than the saturation pressure so that the refrigerant evaporates to establish the dry state (or dry up). When the three-way valve 34 is switched from that state to make a transition to the R-mode, the refrigerant delay occurs, and the refrigerant takes several minutes to reach the exit side of the R-eva 18. One example of the temperature change and the running state at this time is illustrated in FIG. 10.

Figure 10:
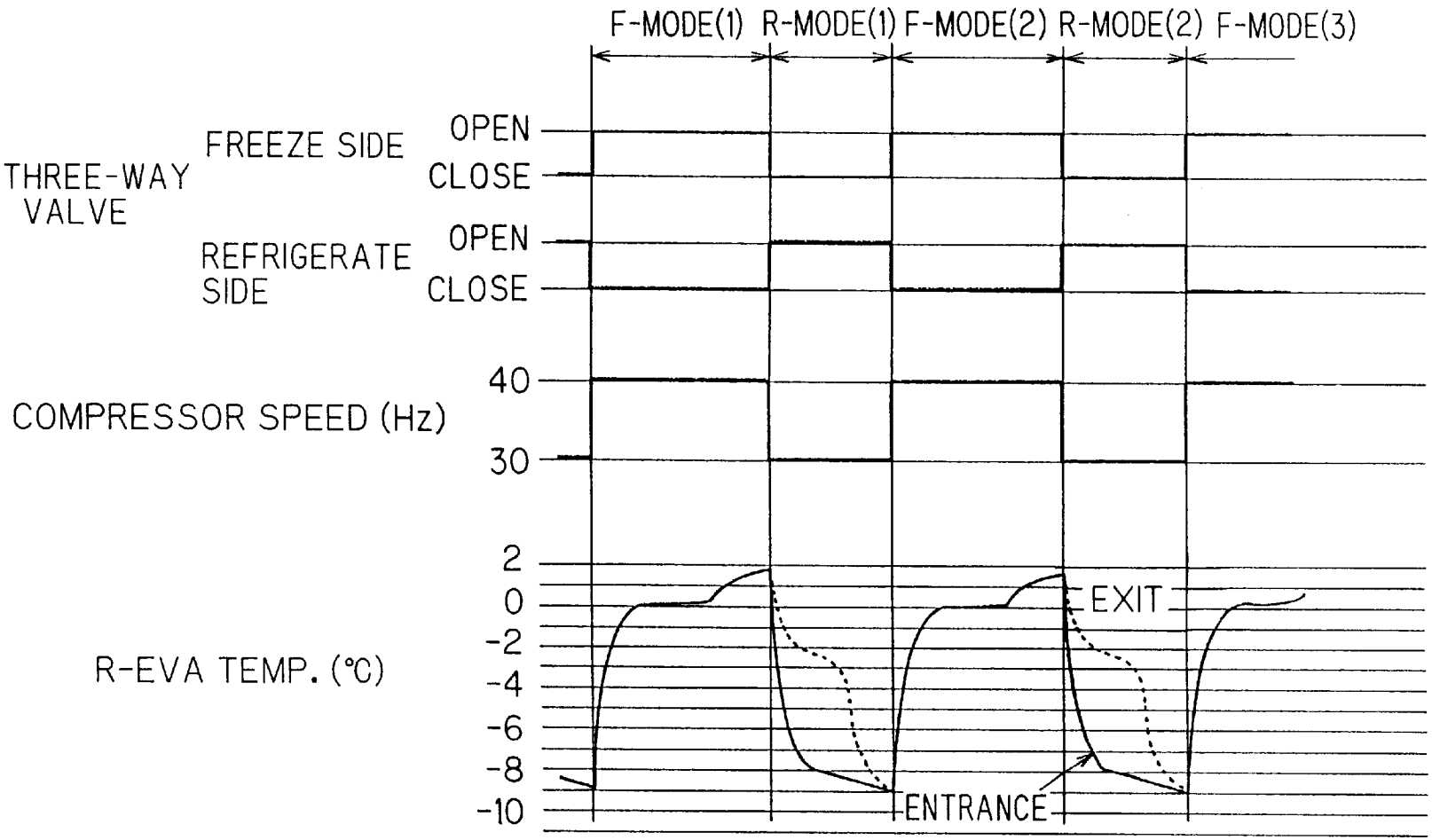
FIG. 10 is a timing chart plotting the temperature of a real R-Eva and the speed of the compressor.

As illustrated in FIG. 10, the refrigerant delay occurs in the R-eva 18, which is not effectively exploited in this state. If a back flow is caused for any factor from the check valve 26, on the other hand, the refrigerant becomes short in the R-eva 18.

If the speed of the compressor 12 is controlled to avoid such shortage, it is complicatedly varied to generate abnormal sounds or noises thereby to deteriorate the reliability of the compressor 12.

In the steady state, on the other hand, the refrigerant resides on the evaporator side at a low temperature. When the compartment temperatures of the freezer compartment 5 and the refrigerator compartment 2 are near the ambient temperature as just after the power supply, however, much refrigerant may reside in the R-eva 18 in the procedure in which the alternate cooling run is effected by switching the three-way valve 34. Then, it is likely that the refrigerant becomes short even in the F-mode.

Therefore, the control method of the embodiment is executed, as follows.

(2) Control Method of the Present Invention

The present control method will be described with reference to FIG. 11.

Figure 11:
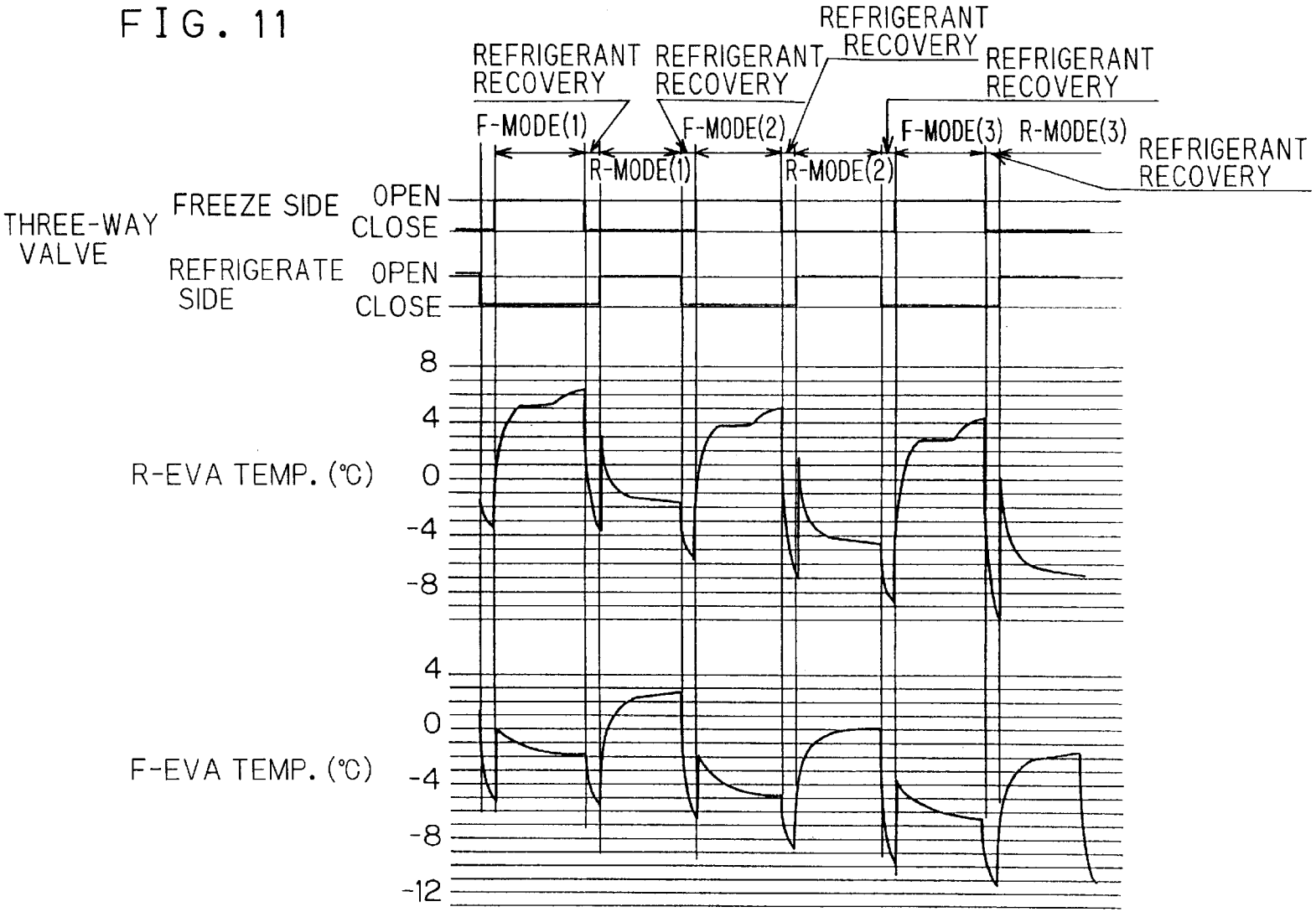
FIG. 11 is a timing chart illustrating the control method of yet another embodiment.

FIG. 11 illustrates the temperatures of the R-eva 18 and the F-eva 24 in the procedure from the power supply to the steady state.

The refrigerant is stagnant on the evaporator side where the temperature is low, as has been described herinbefore. At a high load time as just after the power supply, the evaporator of the lower temperature may be alternately interchanged between the R-eva 18 and the F-eva 24.

Before the interchange from the F-mode to the R-mode and before the interchange from the R-mode to the F-mode, therefore, there is performed the refrigerant recovery run. In this refrigerant recovery run, as has been described in connection with the first embodiment, the three-way valve 34 is closed to cut the refrigerant from the R-eva 18 and the F-eva 24, and the compressor 12 is run to feed the total refrigerant to the condenser 13, in which the C-fan 32 is rotated to recover the total refrigerant necessary for the condenser 13.

Specifically, the cooling is performed by repeating the steps of the R-mode, the refrigerant recovery run, the F-mode, the refrigerant recovery run and the R-mode.

Before the switching the individual modes, therefore, the necessary refrigerant can be migrated to the condenser 13 so that no refrigerant delay occurs in the individual evaporators after the switching. Thus, an efficient cooling can be performed while exploiting the performances of the evaporators thereby to shorten the cooling time.

Next, another embodiment will be described with reference to FIG. 12. This embodiment is a modification of the control method of the previous embodiment.

(1) First Control Method

A first control method will be described.

This description will be made on the R-mode because the refrigerant recovery run is effective in the R-mode.

Figure 12:
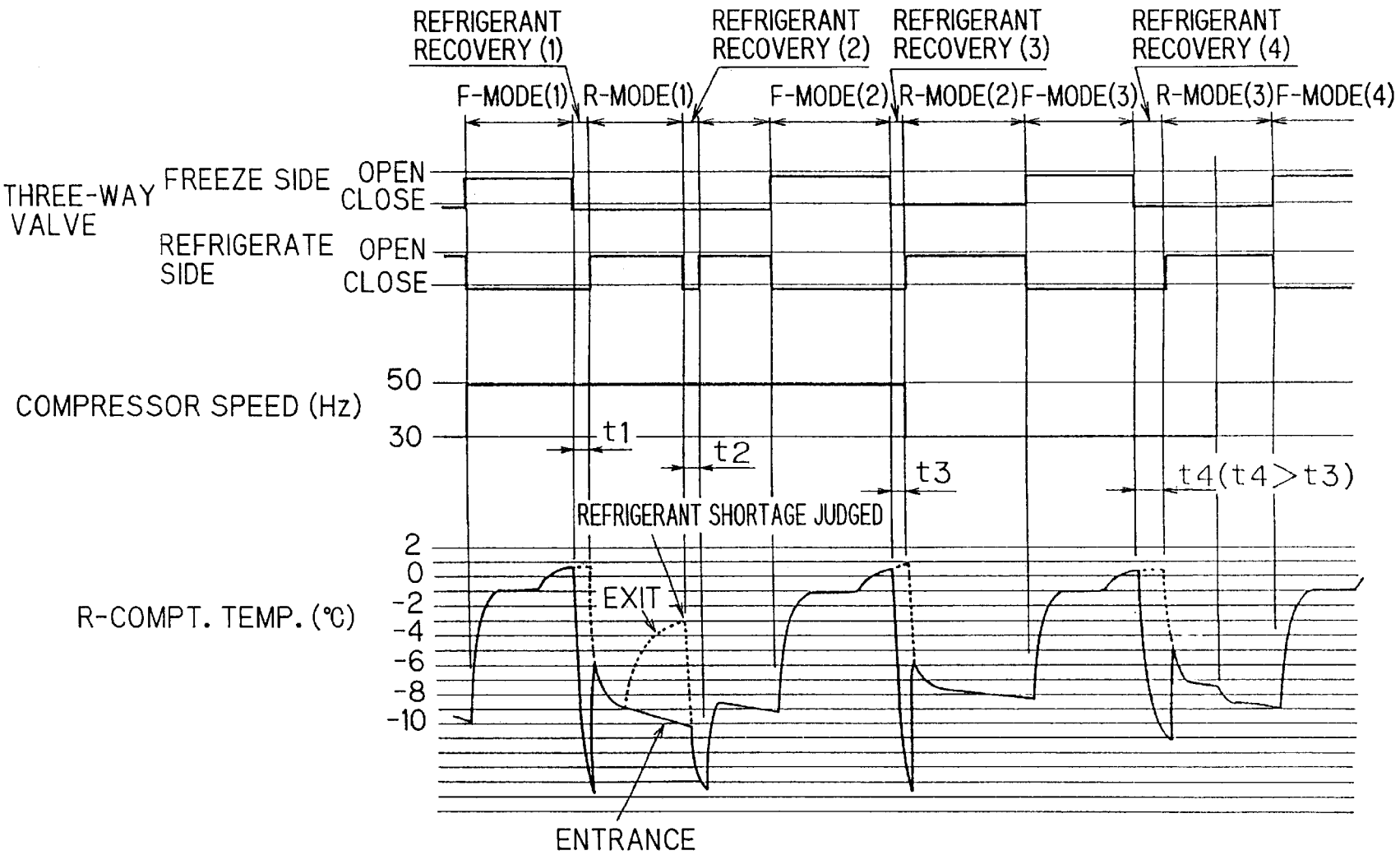
FIG. 12 is a timing chart illustrating yet another embodiment.
Figure 13:
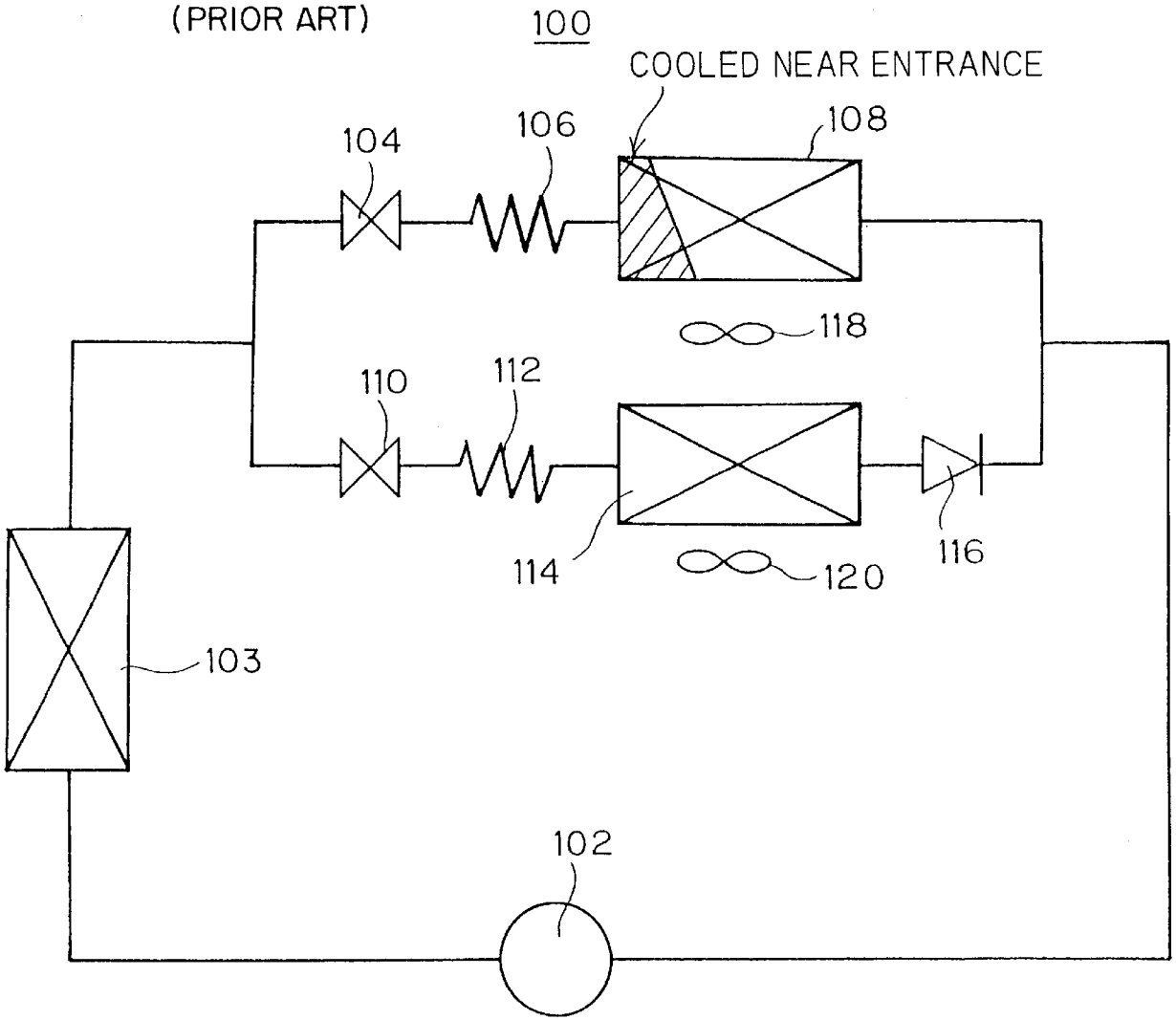
FIG. 13 (PRIOR ART)
FIG. 13 is an explanatory diagram of the freezing cycle of the prior art.
Figure 14:
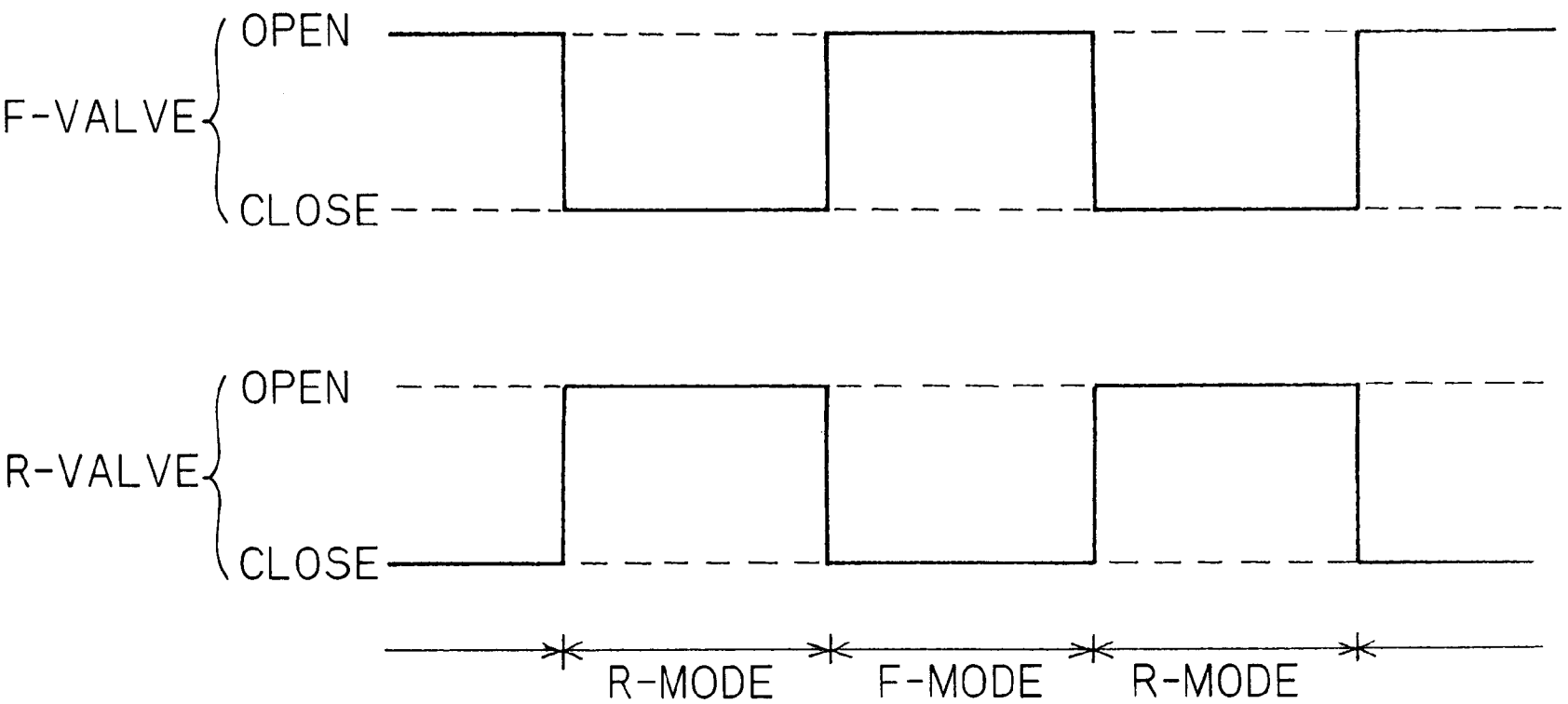
FIG. 14 (PRIOR ART)
FIG. 14 is a timing chart illustrating the control state of the prior art.

In FIG. 12, it is assumed that the difference in the R-mode between the entrance temperature and the exit temperature of the R-eva 18 be so large as to invite a short state of the refrigerant. Specifically, this refrigerant shortage is determined when there is a difference between the temperatures which are individually detected by the temperature sensors disposed on the entrance side and the exit side of the R-eva 18. While continuing the runs of the compressor 12 and the C-fan 32 being continued, moreover, the three-way valve 34 is fully closed to make a transition to the refrigerant recovery run (2).

After this refrigerant recovery run (2) is continued for 1 minute, for example, there is restored the R-mode (1) before the transition to the refrigerant recovery run.

Then, even if the refrigerant leakage from the check valve 26 gradually increases in the R-mode (1) so that the refrigerant flows from the R-eva 18 to the F-eva 24 and becomes short, it is made possible by performing the refrigerant recovery to effect the cooling again while exploiting the performance of the R-eva 18 and to keep the balance of the refrigerant.

Here, the judgment of the refrigerant shortage is made in terms of the entrance temperature and the exit temperature but may also be made when the temperature of the air blown into the compartment rises.

(2) Second Control Method

A second control method will be described.

In the R-mode where the refrigerant delay easily occurs when the alternate cooling runs are alternately switched by the time sharing manner or according to the temperature condition in the compartment, the refrigerant recovery run is performed as in (1), (3) and (4) before the transition from the F-mode to the R-mode.

If a command to switch the mode to the R-mode from the state (i.e., the F-mode), in which the three-way valve 34 has communication with the F-eva 24 is made either for every constant time periods or according to the compartment temperature, the three-way valve 34 is then filly closed while the runs of the compressor 12 and the C-fan 32 being continued. Then, much refrigerant, as stagnant in the F-eva 24 or the accumulator 36, migrates to the condenser 13 so that it is liquefied.

This refrigerant recovery run is performed for on minute, for example, the R-mode is established by switching the three-way valve 34 to communicate with the R-eva 18.

By this control, in the R-mode where the refrigerant delay is likely to occur at the stable time when the compartment temperature is approximately the set level, an efficient cooling can be performed while exploiting the performance of the R-eva 18 sufficiently, to establish a high freezing ability.

(3) Third Control Method

The amount of the refrigerant to be recovered by the refrigerant recovery run depends on the speed of the compressor 12. It is, therefore, desirable to perform the refrigerant recovery run for the running time period proportional to the speed of the compressor 12.

In FIG. 12, the F-mode (2) transits during the cooling at the rpm of 50 Hz to the R-mode (2). At this time, the compressor 12 keeps the rpm of 50 Hz which has been set in the F-mode before the transition. The recovery time t3 at this time is exemplified by one minute.

In the F-mode (3), the cooling is continued at 30 Hz. At the switching to the R-mode, the transition is made like before to the refrigerant recovery run (4) while continuing the rpm of 30 Hz.

A recovery time t4 at this time is set to a longer value of 3 minutes than the value of 1 minute of the time t3 for the refrigerant recovery at 50 Hz.

In short, a proper amount of refrigerant can be recovered by setting the refrigerant recovery time for the low speed of the compressor 12 longer than that for the high speed.

(4) Fourth Control Method

In the refrigerant recovery run, the amount of refrigerant to be recovered depends not only on the speed of the compressor 12, as described above, but also on the ambient temperature at which the refrigerator 1 is placed.

Therefore, the running time of the refrigerant recovery run is so set according to the ambient temperature that it is set longer for the lower ambient temperature but shorter for the higher ambient temperature.

(5) Fifth Control Method

In the refrigerant recovery run, the temperature of the evaporator or accumulator 36 on the refrigerant recovery side is lowered by the evaporation of the refrigerant. If the R-fan 28 or the F-fan 30 corresponding to that evaporator is then rotated, the cool air can be circulated to make a contribution to the constant temperature in the compartment.

At the time of the refrigerant recovery run (4) of FIG. 12, specifically, the temperature falls more in the F-eva 24 than in the R-eva 18. By rotating the F-fan 30, the freezer compartment 5 can then be cooled even in the refrigerant recovery run.

The stop of the F-fan 30 at this time is timed, as follows.

The running time of the F-fan 30 or the R-fan 28 is about one to two minutes, over which there are invited an increase in the fan input and an according rise in the compartment temperature.

Therefore, the temperature rise of the F-eva 24 is detected so that the F-fan 30 is stopped if the detected temperature exceeds −20° C., for example.

Accordingly, as has been described hereinbefore, at the switching from the F-mode to the R-mode, the refrigerant delay can be prevented to control the refrigerant circulation correctly thereby to maximize the cooling ability.

Accordingly, at the time of stopping the run from the F-mode or the R-mode, it is possible to prevent the refrigerant delay for the next run restoration.

Accordingly, the balance in the amount of the refrigerant to stagnate in each evaporator can be adjusted, if necessary, to feed a proper amount of refrigerant to each evaporator thereby to perform an efficient cooling.

Accordingly, when the refrigerant flows backward from the evaporator for the refrigerator compartment to the evaporator for the freezer compartment so that the refrigerant shortage is determined in the evaporator for the refrigerator compartment, or when the run is switched from the freezing run liable to invite the refrigerant delay to the refrigerating run, the refrigerant recovery is performed so that an efficient cooling can be established while exploiting the performances of the individual evaporators sufficiently.

Accordingly, the speed of the compressor at the refrigerant recovering time continues that before the transition to the refrigerant recovery run so that the control can be facilitated to prevent the complicated speed fluctuation thereby to reduce the generation of the noises.

Accordingly, the running time for the refrigerant recovery run is set the longer for the lower speed of the compressor so that the proper amount of refrigerant can be recovered by the simple control.

Accordingly, the running time for the refrigerant recovery run is set the longer for the lower ambient temperature so that the proper amount of refrigerant can be recovered by the simple control.

Accordingly, the exit temperature of each evaporator or the temperature of the accumulator is detected so that the refrigerant recovery run is stopped when the detected temperature is lower than the set level. Even during the refrigerant recovery run of an arbitrary time period, therefore, an excessive refrigerant recovery can be prevented to suppress the reliability deterioration of the compressor.

Accordingly, in the refrigerant recovery run, by running the circulation fan before the transition at an arbitrary speed for the constant time period, the cold heat by the refrigerant evaporation can be circulated in the compartment to cool the compartment on the drive side of the circulation fan efficiently and to make a contribution to the constant temperature.

Accordingly, the cold heat effect by the refrigerant evaporation can be effectively circulated in the compartment thereby to suppress the input increase, as might otherwise be caused by driving the circulation fan excessively.

What is claimed is:

1. A refrigerator comprising:

a compressor and a condenser connected in the recited order;

an evaporator for a refrigerator compartment and an evaporator for a freezer compartment both connected in parallel to the downstream side of the condenser, and a switching unit interposed between the condenser and the two evaporators for switching the passage for a refrigerant from the condenser, between the refrigerator compartment evaporator and the freezer compartment evaporator; and a condenser fan for cooling the condenser, a cold air circulation fan for the refrigerator compartment for blowing the cold wind of the refrigerator compartment evaporator to the refrigerator compartment, and a cold wind circulation fan for a freezer compartment for blowing the cold air of the freezer compartment evaporator to the freezer compartment, whereby a refrigerating run for cooling the refrigerator compartment by feeding the refrigerant to the refrigerator compartment evaporator and a freezing run for cooling the freezer compartment by feeding the refrigerant to the freezer compartment evaporator can be individually executed by switching the passage of the refrigerant by the switching unit, wherein at the end of the freezing run, a refrigerant recovery run for recovering the refrigerant from the refrigerator compartment evaporator and feeding it to the condenser is performed by running the compressor while blocking the refrigerant to flow tot he freezer compartment evaporator with the switching unit and by running the condenser fan; and wherein after the temperature of the freezer compartment evaporator reaches a predetermined level after starting of the refrigerant recovery run, the refrigerating run is performed by switching the switching unit to feed the refrigerant only to the refrigerator compartment evaporator.

2. A refrigerator according to claim 1, wherein in that after the refrigerating run was performed by switching the switching unit to feed the refrigerant only to the refrigerator compartment evaporator, the cold air circulation fan for the refrigerator compartment is run when the temperature of the refrigerator compartment evaporator falls to a set level.

3. A refrigerator according to claim 1 or 2, wherein when the compressor is stopped from the freezing run or the refrigerating run, a stop preparatory run for recovering the refrigerant from the freezer compartment evaporator or the refrigerator compartment evaporator to feed the refrigerant to the condenser is performed by running the compressor while switching the switching unit to block the refrigerant to be fed to the freezer compartment evaporator or the refrigerator compartment evaporator, and by running the condenser fan at a low a speed; and wherein after the stop preparatory run, the compressor and the condenser fans are stopped while the refrigerant to be fed to the freezer compartment evaporator or the refrigerator compartment evaporator is blocked by the switching unit.

4. A refrigerator according to claim 3, wherein after a set time from the start of the stop preparatory run, the compressor and the condenser fan are stopped while the refrigerant to be fed to the freezer compartment evaporator or the refrigerator compartment evaporator being blocked by the switching unit.

5. A refrigerator according to claim 3, wherein after the drive current value of the compressor becomes lower than a set level from the start of the stop preparatory run, the compressor and the condenser fan are stopped while the refrigerant to be fed to the freezer compartment evaporator or the refrigerator compartment evaporator is blocked by the switching unit.

6. A refrigerator according to claim 1 or 2, wherein the switching unit includes two two-way valves.

7. A refrigerator according to claim 1 or 2, wherein the switching unit includes a three-way valve.

* * * * *